US007389612B1

(12) United States Patent
Fischbeck

(10) Patent No.: US 7,389,612 B1
(45) Date of Patent: Jun. 24, 2008

(54) GEODESIC STRUCTURE

(76) Inventor: Richard D. Fischbeck, 433 Bluff Road, Northport, ME (US) 04849

( * ) Notice: Subject to any disclaimer, the term of this patent is extended or adjusted under 35 U.S.C. 154(b) by 0 days.

(21) Appl. No.: 09/928,717

(22) Filed: Aug. 9, 2001

(51) Int. Cl.
*E04B 1/32* (2006.01)

(52) U.S. Cl. ..... 52/81.1; 52/81.4; 52/82; 52/DIG. 10; 52/655.2

(58) Field of Classification Search ..... 52/81.1, 52/81.4, 80.1, 655.1, 655.2, DIG. 10, 82, 52/554
See application file for complete search history.

(56) References Cited

U.S. PATENT DOCUMENTS 1,009,434 A * 11/1911 Mohr ..... 362/328
1,200,487 A * 10/1916 Grimm ..... 362/121
2,549,189 A * 4/1951 Gabo ..... 52/591.1
2,682,235 A 6/1954 Fuller
2,835,112 A * 5/1958 Monnet ..... 405/29
2,839,841 A * 6/1958 Berry ..... 434/278
2,905,113 A * 9/1959 Fuller ..... 52/81.5
2,914,074 A * 11/1959 Fuller ..... 52/81.4
3,197,927 A 8/1965 Fuller
3,203,144 A * 8/1965 Fuller ..... 52/81.4
3,331,145 A * 7/1967 Amadahl ..... 52/81.1
3,359,694 A * 12/1967 Hein ..... 52/81.2
3,578,331 A * 5/1971 DeGast ..... 52/81.1
3,665,882 A * 5/1972 Georgiev et al. ..... 114/266
3,729,876 A * 5/1973 Kolozsvary ..... 52/81.4
3,785,066 A * 1/1974 Tuitt ..... 434/403
D233,467 S * 10/1974 Lamp ..... D26/88
3,841,039 A * 10/1974 Farnsworth, III ..... 52/81.1
3,876,492 A * 4/1975 Schott ..... 52/789.1
3,959,937 A 6/1976 Spunt
3,977,138 A * 8/1976 Chastain ..... 52/81.4
4,092,810 A * 6/1978 Sumner ..... 52/81.4
4,128,104 A * 12/1978 Corey ..... 135/124
4,146,997 A * 4/1979 Diethorn ..... 52/81.4
4,207,715 A * 6/1980 Kitrick ..... 52/81.4
4,263,758 A * 4/1981 Seaich ..... 52/81.1
4,270,320 A * 6/1981 Chamberlain ..... 52/81
4,380,133 A * 4/1983 Arnstein ..... 446/488
4,425,740 A * 1/1984 Golden ..... 52/81.1
4,555,878 A * 12/1985 Tringali ..... 52/81.1
4,679,361 A * 7/1987 Yacoe ..... 52/81.1
4,686,801 A * 8/1987 Eriksson et al. ..... 52/81.5
4,794,742 A * 1/1989 Henderson ..... 52/80.2
4,825,602 A * 5/1989 Yacoe ..... 52/81

(Continued)

FOREIGN PATENT DOCUMENTS

GB 2232695 * 12/1990 ..... 52/81.1

(Continued)

OTHER PUBLICATIONS

Cosmology p. 2—Internet URL http://www.jp-petit.com/science/ingeph_f/text_en/a102.htm.

(Continued)

*Primary Examiner*—Phi Dieu Tran A
(74) *Attorney, Agent, or Firm*—Patricia M. Mathers

(57) ABSTRACT

A geodesic structure comprising convex-concave elements. The elements are easily manufactured, simple shapes that can be assembled randomly to form a geodesic structure, such as a dome. The geodesic structure can also be used to make flat maps of spherical bodies, exhibiting very little distortion.

9 Claims, 7 Drawing Sheets

U.S. PATENT DOCUMENTS

| | | | | | |
|---|---|---|---|---|---|
| 4,866,902 | A | | 9/1989 | Arciszewski | |
| 5,222,896 | A | | 6/1993 | Smith, Jr. | |
| 5,340,349 | A | * | 8/1994 | Berg-Fernstrum | 446/126 |
| 5,377,460 | A | * | 1/1995 | Hicks | 52/81.1 |
| 5,411,047 | A | * | 5/1995 | Reilly | 135/127 |
| 5,524,396 | A | * | 6/1996 | Lalvani | 52/81.1 |
| 5,628,154 | A | * | 5/1997 | Gavette | 52/81.4 |
| 5,904,006 | A | * | 5/1999 | Evans | 52/81.4 |
| 6,074,509 | A | * | 6/2000 | Pittman | 156/213 |
| 6,098,347 | A | * | 8/2000 | Jaeger et al. | 52/81.3 |
| 6,418,673 | B1 | * | 7/2002 | Flowerday | 52/81.1 |
| 6,457,282 | B1 | * | 10/2002 | O'Toole | 52/81.2 |
| 6,499,260 | B2 | * | 12/2002 | Kasinger et al. | 52/79.4 |

FOREIGN PATENT DOCUMENTS

| | | | | |
|---|---|---|---|---|
| JP | 41583 | * | 2/2002 | 52/81.4 |

OTHER PUBLICATIONS

Cosmology p. 3—Internet URL http://www.jp-petit.com/science/ingeph_f/text_en/a103.htm.
Dymaxion Air-Ocean World Map p. 1—Internet URL http://www.pbs.org/wnet/bucky/dymap.html.
Large Wooden Geodesic Map p. 1—Internet URl http://www.creative-science.org.uk/galwood.html.

* cited by examiner

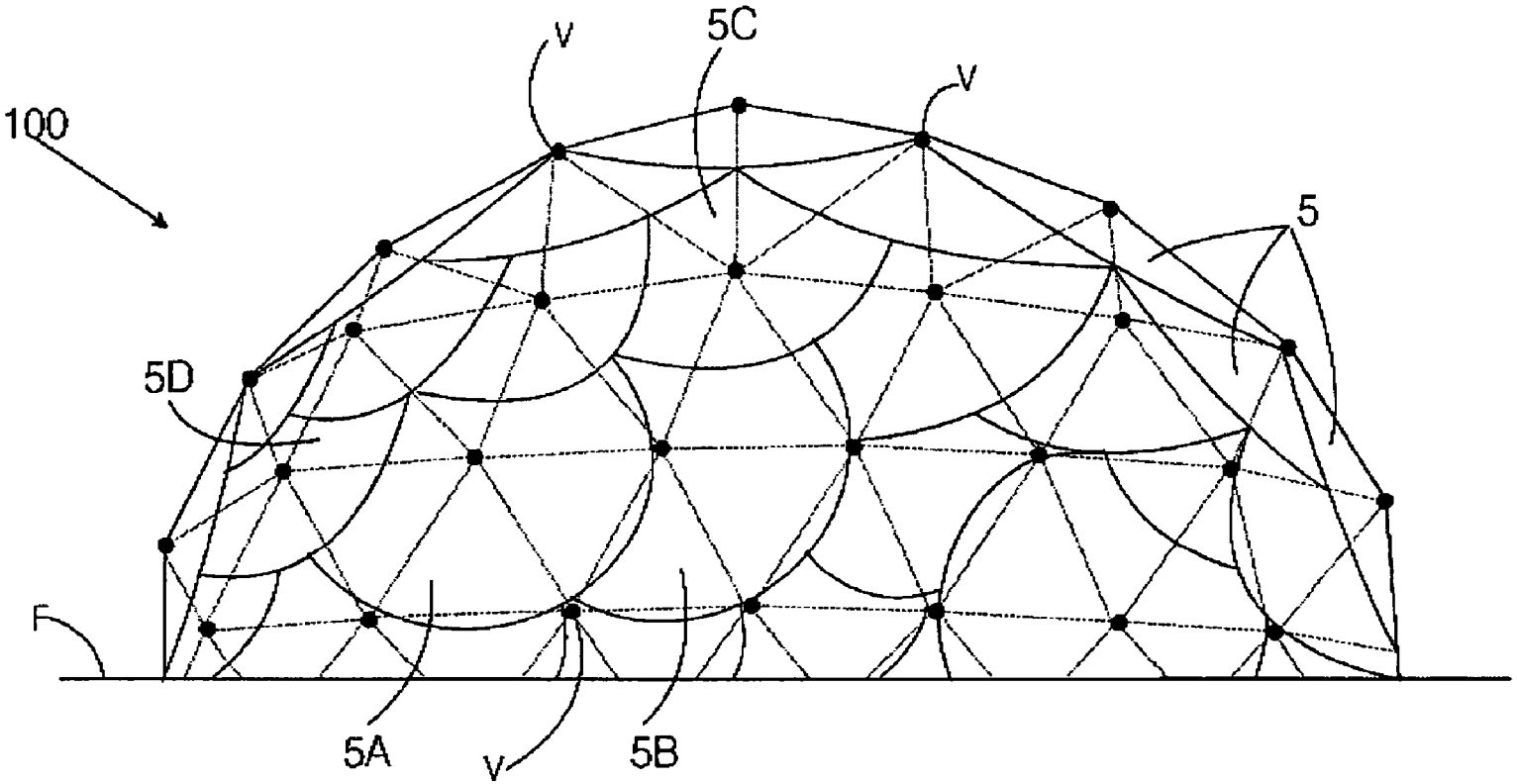
FIG. 4
(AMENDED)

GEODESIC STRUCTURE

BACKGROUND INFORMATION

1. Field of the Invention

The invention relates to the field of spherical structures. More particularly, this invention relates to spherical structures assembled from a plurality of convex-concave elements.

2. Description of the Prior Art

Spherical structures as referred to herein include structures that have either a continuously curved or a faceted spherical shape, as well as structures that are semispherical, such as domes, or completely spherical, such as globes. Spherical structures have many and varied applications, but offer particular advantages as spatial enclosures. Not only is the sphere aesthetically pleasing, but it possesses certain structural advantages that make it stronger, more stable, and better able to resist certain forces, such as those resulting from wind, earthquakes, and other natural phenomena, than rectangular structures of comparable size. Nevertheless, despite the structural advantages of spherical over rectangular structures, spherical structures are not commonly used as spatial enclosures and have been constructed primarily for very special purposes. Examples of such special purpose spherical structures are the ancient domes that crown great cathedrals and the arches that impart strength to load-bearing structures such as aqueducts and bridges. Typical housing structures are, however, generally rectangular or cylindrical structures. Several reasons for the lack of use of spherical structures as housing or shelter are based on the fact that such structures are geometrically very complicated and difficult to build; they require special knowledge of spherical geometry and considerable mathematical ability. Thus, making such structures requires specialists and extensive working or shaping of the individual elements, resulting in a structure that is more costly to construct, relative to a rectangular structure of comparable size.

Richard Buckminster Fuller radically altered the task of designing and constructing a spherical structure with his innovative geodesic dome. See U.S. Pat. Nos. 2,682,235 (Fuller; issued 1954), 2,905,113 (Fuller; issued 1959), and 2,914,074 (Fuller; issued 1957). The Fuller geodesic dome is a spherical structure based on a system of regularly-spaced and intersecting gridlines formed by great circles or arcs of a common sphere. The intersecting gridlines form what has come to be known as "geodesic" patterns of nearly equilateral triangles, diamonds, hexagons, or pentagons. The concept of a geodesic dome was a breakthrough in structural form a and design of spherical structures in that it provided a way to construct an approximately spherical structure entirely of planar elements arranged in a straight-edged angular framework, or of flexible elements that were suspended from such an angular framework and allowed to curve to form the overall spherical shape. Examples of such structures include the United States pavilion at the World Expo in Montreal in 1967 and, more recently, sports stadiums like the Astrodome, or the Epcot Center near Disney World in Florida.

The geodesic domes disclosed in U.S. Pat. Nos. 2,682,235 and 2,914,074 comprise a framework of struts and triangular panels arranged within the framework. The structure of a geodesic dome is typically based on a spherical icosahedron, i.e. a polyhedron having twelve vertexes and twenty triangular faces that are superimposed onto a sphere. Each of the twenty faces is a near-equilateral triangle, referred to herein as a "basic triangle". This geodesic principle of forming a spherical structure from triangular elements only is often referred to by R. B. Fuller as omni-triangulation. The basic triangles of the icosahedron can be further sub-divided along great circle gridlines to create a geodesic structure that approaches more closely a spherical shape. In other words, each basic triangle of the icosahedron can be sub-divided into numerous smaller triangular elements, thereby enabling a relatively large, flat surface of the basic triangle to be broken into many relatively smaller, flat, near-equilateral triangles that can then be assembled to provide the basic triangle with a contour that approaches a curve. The number of sub-divisions of each basic triangle along great circle gridlines with reference to geodesic domes is referred to as the frequency of the dome. Thus, a spherical structure consisting of twenty basic triangles (faces) and twelve vertices has a frequency of one and if the faces are sub-divided by great-circle gridlines that crisscross the triangle in an even grid, the structure has a frequency equal to the number of segments along every side of the basic triangle. For example, if each side of the basic triangle is divided into four segments, the structure has a frequency of four. The higher the frequency of a geodesic structure, the smaller the individual elements become relative to elements in a sphere of the same size having a lower frequency, and the more closely the complete structure can be constructed to approach a spherical form.

Increasing the frequency of the basic structure increases the number and reduces the size of the interdependent triangular elements that make up the basic triangle of the icosahedron. This makes it easier to transport the elements, which can otherwise be difficult if the basic triangle is very large, as is the case with structures such as sports stadiums. One of the disadvantages of the conventional geodesic dome structure is the necessity of constructing a framework of struts in a triangular pattern and then fitting the framework with a skin, or assembling planar elements onto the frame. While the theory behind the geodesic dome appears strikingly simple, enormously complex mathematical operations are required to calculate the precise geometry of the struts and panels. The tolerances required to make a large geodesic dome actually approach those typical of the aircraft industry. This is because six struts must meet precisely at a vertex. Just a few minute errors in the calculation or manufacture of the strut lengths will result in vast discrepancies elsewhere in the structure. Furthermore, although all the triangles in a geodesic grid appear to be of uniform size, the triangles actually differ slightly in size and must be assembled in proper order. This requires that the struts forming the triangles must be identified and assembled in a precise order and, if planar elements are inserted in the framework, each element must be identified and assembled in precise order. Because of the complex calculations required when designing the structural elements of a conventional geodesic dome, it is extremely difficult for persons having ordinary building skills, tools, and materials to construct a dome that has the structural integrity necessary for creating a sturdy and stable structure for shelter.

U.S. Pat. No. 4,270,320 (Chamberlain; issued 1981) discloses a frameless dome structure. This structure comprises circular, spherically curved structural elements, each element having a curvature equal to the curvature of the complete spherical enclosure. The elements are overlapped and attached to each other to create a substantially round, i.e. continuously curved, spherical structure. A key feature of this structure is that each structural element has a spherically curved exterior surface. This requires that the elements be manufactured in precise spherical shapes, that is, the elements must be molded or pressed to form a curved contour that corresponds to the curvature of the complete spherical structure.

A modular dome structure constructed of identical ring-shaped elements that are arranged in even horizontal and vertical rows is disclosed in U.S. Pat. No. 3,959,937 (Spunt; issued 1976). Each ring has four reinforcing ribs to impart rigidity and strength to prevent the rings from deforming into oval shapes. This structure is not a geodesic structure as it is not an omni-triangulated structure. Consequently, the Spunt structure does not offer the structural advantages of strength and flexibility for which the geodesic structure is known.

It may also be desirable to create a structure that is not spherical in shape, in the sense of being a globe, but that is compoundly curved, such as is a pear or a canoe, to form an irregularly curved structure in which the radius of curvature of the structure varies across the outer surface. Compoundly curved structures having a surface with changing radius of curvature are typically based on a plurality of elements having varying curvatures are known, as are compoundly curved structures that are based on hexagonal elements intermixed with a pentagonal element at the vertex. The disadvantages of such structures are similar to those of the conventional geodesic structure—they require very complex mathematical operations.

Spherical structures have well-known uses other than for housing. One such use is that of a globe, i.e., a spherical structure onto which a map of a spherical body is projected. A globe of the earth, for example, displays a map of the earth with the least amount of distortion, because the shape of the globe very closely approximates that of the earth itself. It is not always practical to use a globe, however, and thus, flat two-dimensional maps are often used to show a map of the earth. A two-dimensional map, however, has an inherent disadvantage in that it gives a distorted illustration of a spherical shape. Different types of maps have been devised over the centuries in an attempt to minimize the distortion. An example of one such attempt is the "orange segment" (homolosine) map, which shows the earth laid out as segments of a circle on a two-dimensional plane, with an "empty" space between the upper and lower ends of the segments. This projection of the earth presents less distortion than the map, but some features of interest, such as the areas in or near the polar regions appear disjointed and distorted.

Buckminster Fuller attempted to overcome this problem of map-making by creating the "dymaxion" map. The underlying "globe" on which this map is displayed is not a continuously-curved sphere, but, rather, the spherical icosahedron already known from Fuller's basic geodesic dome structure. Because the icosahedral sphere approximates the shape of the sphere, the map of a spherical body projected onto such a sphere has only a minimum amount of distortion due to the inherent differences in shape between the body to be mapped and the icosahedral sphere. When making the dymaxion map, the icosahedron is so arranged that vertex-to-vertex cuts in the icosahedron do not cross continental landmasses, but are placed, instead, across oceans where the distortion is not as critical. The icosahedron can then be cut along edges of several triangles and laid out flat. The outer contour of the map appears very irregular, but the features of interest on the map, such as the large land masses, are not separated when the icosahedron is cut into a flat map, and the distortion is low. See "The Dymaxion Map", The Buckminster Fuller Institute. The basic icosahedron of 12 vertexes and 20 faces, however, allows no flexibility in the basic size of the triangles relative to each other and, therefore, is less useful when presenting a map of the heavenly constellations or even of the earth, in which a certain geographic constellation is to be emphasized.

Thomas Smith, Jr. expanded on Fuller's dymaxion map and provided a polyhedral approximation of a spherical body from which a planar map with minimum distortion can be made. See U.S. Pat. No. 5,222,896 (Smith, Jr.; issued 1993). Smith shows a map of the stellar constellations and another one of the earth's moon (FIGS. 10 and 11). The first of these maps comprises a plurality of trapezoidal, pentagonal and hexagonal planar elements that are linked with each other to approximate a spherical structure. The second map comprises a plurality of triangular, F trapezoidal, and pentagonal elements. The elements in both maps vary widely in size and are irregular in shape, i.e., each leg of an element may be a different length. The shapes and sizes of the elements are selected to provide the most sensible and useful presentation of the constellations. The disadvantages of these maps are that, because of the extreme variation in sizes of the elements, the distortion on the map is uneven and may be quite significant.

What is needed, therefore, is a spherical or near-spherical structure constructed of simple structural elements that are easily and inexpensively manufactured. What is further needed is such a structure that can be easily assembled without requiring that the elements be placed or fastened along predetermined great-circle gridlines. What is yet further needed is such a structure for which the necessary materials for a structure of a particular dimension can be easily calculated, without requiring complex mathematical calculations. What is yet further needed is such a structure that is readily adaptable to any compoundly curved shape and provides great versatility for use in many different types of applications.

SUMMARY OF THE INVENTION

For the above-cited reasons, it is an object of the present invention to provide a spherical or near-spherical structure that is made of elements that are simple and inexpensive to manufacture and to assemble. It is a further object to provide such a structure that is versatile in form and not restricted to the form of an icosahedron limited to one particular frequency or any limited set of frequencies. It is a yet further object to provide such a structure that can be easily assembled without requiring complex mathematical calculations and without having to arrange the elements in a pattern along predetermined great circle gridlines.

The objects are achieved by providing a geodesic structure made of convex-concave elements that are arranged in an approximate manner, without having to be placed or attached along predetermined great-circle gridlines. The example of a dome for human shelter will be used to describe the basic geodesic structure according to the invention, although it should be understood that a complete geodesic sphere, a semisphere, or an irregularly curved structure can also be constructed in a similar manner, and that geodesic structures constructed according to the invention are not restricted to a certain size or to certain applications, such as shelter for humans.

As stated above, the geodesic dome according to the invention is made of convex-concave elements that are assembled in an approximate fashion. By "approximate" is meant that the elements are assembled one next to the other according to some principle such as overlapping or tangentially touching adjacent elements, yet randomly in the sense that particular exemplars of the elements do not necessarily have to be placed or fastened along predetermined great circle gridlines, nor do they have to be placed in a particular sequence or at a particular location. In an initial embodiment of the structure according to the invention, identical, shallow, cone-shaped elements, also referred to as "hub elements," are used as the convex-concave elements and are assembled in an overlapping configuration, typically from the top of the structure downward, although a structure according to the invention could just as well be assembled from the bottom up.

The structure according to the invention is self-adjusting because the hub elements are not necessarily precisely spaced from each other, but are, rather, assembled in an approximate fashion arranged according to some general principle with virtual struts automatically forming along the single-axis curvature that extends from vertex to vertex. The geodesic dome thus constructed will have an overall shape with a curvature that corresponds to an average curvature of all the hub elements, as will be discussed below. Furthermore, the geodesic dome according to the invention is self-triangulated. If lines are drawn from each vertex to adjacent vertexes, one can see that the entire structure is divided into triangles, albeit triangles of varying dimensions, including scalene triangles in which each leg of the triangle is a different length.

Cones were used as the hub elements in a Preferred Embodiment of the geodesic dome according to the invention because cones are easier to work with and less costly than continuously curved elements. Cones can be easily fabricated from a flat circular sheet of construction material by eliminating a section of material from the center to the outer edge of the hub, thereby forming what is hereinafter referred to as an angulardeficit in the sheet. This angular deficit determines the curvature of the hub element, discussed in greater detail below, and is easily formed either by folding that section of the material from the vertex to the outer edge or by cutting the section from the element, and reattaching the cut edges to form the cone. Thus, no machining or shaping of curved elements is required. The cone shape also imparts improved strength and rigidity to the material. Thus, materials that are relatively thin and/or inexpensive can be used to create large spacious enclosures. The elements can be made of a variety of stiffly flexible materials, including but not limited to such materials as paperboard, plywood, oriented-strandboard, cardboard, sheet metal, and sheet plastic or fiberglass material. It is possible, however, to use several different sizes or shapes of hub elements and arrange them in an evenly alternating pattern to form the structure. For example, hub elements of two shapes, i.e., having the same diameter at the outer perimeter, but having different angular deficits, can be assembled in an alternating pattern for an aesthetic effect.

As mentioned above, uniformly-sized hub elements are used to construct the Preferred Embodiment of the geodesic dome. A typical assembly sequence for this embodiment is to arrange a first row of elements around a first single element, such that the first single element overlaps with a portion of each element in the first row of elements so as to not leave a gap between elements. In each subsequent row, additional elements are attached to elements in the preceding row, with the new elements overlapping with a portion of two adjacent elements in a preceding row. Assembly continues in this fashion, row-by-row, to construct a semispherical enclosure. The bottom-row elements are trimmed to form an edge that conforms to the contour of the foundation of the structure. The structure is self-adjusting in the sense that it is sufficient if the elements are placed approximately evenly according to plan. The strut lengths of the virtual struts extending from vertex to vertex of the uniformly-sized hub elements will automatically adapt to the variations in placement of the hub elements. The resulting structure will be a spherical structure with an overall dome curvature that corresponds to the curvature of the individual hub elements.

The use of uniformly-sized cone-shaped elements makes it a simple matter to calculate in advance how many elements are required to build a geodesic structure having a certain dome curvature and a certain diameter. The frequency of a construction, as the term was used in the past in connection with conventional geodesic domes, is not applicable for calculating the elements or size of the structure according to the invention. Rather, calculations are based on simple trigonometric functions, whereby either the number of available hub elements is known, or the internal angle of the hub elements, and the strut length or the radius of the finished dome structure.

For example, 60 circular pieces of material are available for making hub elements to construct a semi-spherical structure of a certain diameter. The solid angle included in a semisphere is 360°. Dividing the solid angle by the number of elements results in an average angular deficit ($\alpha$) of 6° for each hub element. The angular deficit defines the amount of material that is removed from a circular piece to obtain a hub element with an internal angle ($\beta$). The angular deficit $\alpha$ can be formed by determining the arc length on the circumference of the element that corresponds to 6° and removing the section bounded by the arc length and lateral sides that are contingent with radius lines emanating from the center point of the element, or by overlapping the lateral sides such that the new circumference of the element effectively defines an element that is a cone with the desired angular deficit $\alpha$.

An internal angle $\beta$ and an external angle $\theta$ of the individual hub element are based on $\alpha$. For example, $\beta$ is equal to $\sin^{-1}(1-\alpha 360°)$. Thus, if $\alpha$ is 6°, the internal angle $\beta$ is 79.52 and the external angle $\theta$is equal to $180-2\beta$, or 20.96°. The external angle $\theta$ is also referred to herein as the angle of structure $\theta$ when relating the external angle $\theta$ to the overall curvature of the structure. Once the external angle or angle of structure $\theta$ and the diameter of the geodesic structure are known, the strut length, i.e., the distance from vertex to vertex, can be simply calculated by using basic trigonometry. The length of the hub elements, that is, the distance from the vertex to the edge of the hub element, is determined by the strut length and the amount of overlap between elements and can, thus, be easily calculated once the strut length is known.

The size (radius or diameter) of the structure is determined by the strut length. The hub length is greater than or equal to ½ strut length, if the hub elements are arranged so that adjacent elements touch tangentially. If the hub elements are arranged to overlap the maximum amount with adjacent elements, the hub length is approximately equal to the strut length. Thus, the length of the hub element will vary as a function of the desired amount of overlap between adjacent elements. For example, the elements can be overlapped such that the outer edge of one element approaches the center point or vertex of each element that is adjacent to it, or can be overlapped a lesser amount. If the amount of overlap of the hub elements is maximized, such that an outer edge of one hub element approaches the vertex of an adjacent element, then the overall expanse of the structure will be at its smallest for that size hub element. Maximum overlap means that the material of the hub elements is a double thickness, except at the vertexes. This may be desirable to increase the strength and/or rigidity of the structure if relatively thin, inexpensive material is used. On the other hand, if the hub elements are overlapped the minimum amount to provide a completely closed outer surface, the diameter of the structure will be greater for a given use of materials. As long as the elements overlap so as to create a continuous outer boundary, the finished structure will be substantially spherical and will have substantially an overall angle of structure that corresponds to the average external angle of the individual elements.

The geodesic dome according to the invention is constructed preferably such that each row of hub elements extends over the exterior side of the next lower row, thereby creating a structure that is inherently resistant to the ingress of water. The necessity or desirability of overlapping the elements as described will, of course, depend on the intended use of the geodesic structure according to the invention. Any type of suitable fastening means may be used to assemble the elements, such as adhesives, hook-and-loop fasteners such as VELCRO, snaps, screws, nails, bolts, rivets, etc.

In another embodiment of the basic structure according to the invention, the hub elements need not have an identical angular deficit $\alpha$, but rather, the angular deficit can vary. For example, for aesthetic or other reasons, a geodesic dome according to the invention can be constructed of 50% of elements having an angular deficit $\alpha$ of 6° and 50% of elements having an angular deficit $\alpha$ of 12°. The overall angular deficit $\alpha$ then corresponds to an average of the angular deficits of the elements, in this case, 9°. Note the constraint that the sum of the angular deficit of the hub elements be approximately 720° for a sphere or approximately 360° for a semisphere.

When hub elements of varying angular deficit and/or size are assembled in a repeating pattern, it can be seen that the resulting structure is still an omni-triangulated geodesic structure in that the "strut" lines between vertexes exhibit a pattern of lines along great-circle-chord gridlines and form a system of omni-triangulated shapes. The lines, however, correspond to chords of partial great circle gridlines and the triangles may vary in size and be scalene. Furthermore, the structure according to the invention has no frequency that corresponds to the concept of frequency as applied to conventional geodesic structures. Rather, these structures are named according to the number of vertexes the structure would have if the structure were to form a complete sphere. For example, a semispheric structure in which the hub elements have an angular deficit of 6° is referred to as a 120-Vertex structure.

The geodesic structure according to the invention can be constructed of hub elements other than the cones that have been described above. Key features of the invention are the convex-concave shape of the elements and random assembly of the elements to provide a curved shell. Other types of elements that are within the scope of the invention include cones that are arranged so as to touch adjacent cones tangentially, with the narrow end pointing in toward the center of the structure. Similarly, the hub elements can be tapered triangular cones. The angle of taper of the cones will determine the curvature of the structure. In embodiments of the invention that use an arrangement of tangentially touching cones, an outer skin or cladding can be used to cover the shell, thereby providing a structure that is lightweight, structurally strong, and, depending on the cladding, provides shelter from rain, snow, cold, and/or heat, in spite of the fact that the elements have no overlap.

A further embodiment of the invention uses tensegrity elements, such as strutted frames, as hub elements. By "tensegrity" is understood that the tension and compression forces of a structure have been separated into tension components and compression components that cooperate with each other to maintain the integrity of the structure. One example of a tensegrity element is a frame composed of compression struts held together by a tension chord that forms the outer boundaries of the element and forces the struts into a convex-concave relationship. The tensegrity elements (frames) are connected to each other at the strut ends, so as to allow the structure to "self-adjust" and form a cohesive, integrated, geodesic structure. Adjustable couplers may be used to connect the struts in a self-adjusting construction. A skin or cladding can be used to cover the structures created with these tensegrity elements to enclose the space within.

The fact that the structure according to the invention can be assembled from elements that are not precisely aligned along predetermined great-circle gridlines, and can be assembled with a certain amount of "sloppiness", provides a great advantage. Any structure according to the invention can be assembled with simple tools and by people who are relatively unskilled in the art of building construction. A kit comprising the hub elements, assembly instructions, and perhaps a guide or jig to aid in constructing a structure of standard size and shape that will fit on pre-fabricated foundations, can be provided. The kit can also include door frames and window frames that are installed in openings cut into the structure. Transparent and/or screen mesh elements can be provided to be placed in the structure as windows and circulation openings. Thus, it is possible to provide an emergency housing kit, for example, that can be quickly assembled by persons of ordinary skill and education to provide temporary shelter units. The hub elements are neatly stackable in bundles that can be easily transported and delivered to the site of an emergency or natural catastrophe and then assembled by local people there where shelter is needed immediately.

It is also possible to deliver pre-assembled structures according to the invention. When pre-assembled, the structures can be rolled like a cigar and trucked or air-lifted to remote regions. It is, of course, also possible to provide a kit of elements and fasteners, whereby the fasteners are self-drilling or the elements have been provided with fastener bores, assembly mounts, or adhesive strips, etc., for quick assembly. As mentioned above, the construction material for such shelters according to the invention can be any suitably stiffly flexible material or a combination of materials. For example, in very cold climates, an outer dome of sheet metal and an inner dome of suitable insulating material may be concentrically assembled to provide a warm, energy-efficient shelter.

The geodesic structure according to the invention is not limited to use for human shelters, but can be used for any number of other applications, such as camping units, pet houses, playhouses, tool sheds, etc. For example, kits of preformed plastic hub elements with hook-and-loop fasteners such as VELCRO can be provided for children to construct as playhouses.

In addition to providing easily assembled structures for emergency housing, map-making is another particularly useful application for geodesic structures constructed of irregularly-sized hub elements. Understandably, the least amount of distortion of a map is provided when the map is projected onto a shape that is similar to the shape of the body being mapped. For this reason, the globe provides the least amount of distortion when the earth is mapped. Two-dimensional flat maps are more commonly used, however, because they are more convenient to store, transport, carry, etc., in spite of the significant distortion the flat maps ("projections") present. With the structure according to the present invention, it is possible to project a map of the earth, for example, onto the structure in such a way that the distortion is kept to a minimum and does not disrupt features of particular interest. For example, to provide a map that shows the country Norway and the air routes used to travel from Norway to other parts of the world, one proceeds as follows: First, a map of the earth is projected onto a sphere. Vertexes are marked on places that are of particular interest and variously sized triangles drawn around the vertexes to provide a map showing Norway in the center and the major air routes from Norway. The triangles are drawn such that the geodesic structure can be cut along sides of several triangles, without separating or radically distorting particular geographic areas when the globe is laid out to a flat map. This type of map has even less distortion than the dymaxion map disclosed by Fuller, and it is possible to draw the triangles such that the distortion and cut-lines of the map occur in the middle of features of less interest, such as in the middle of oceans, or the Antarctic land mass, etc. Similarly, flat maps that present the objects of greatest interest with the least amount of distortion can be made of the heavenly skies, or of other spherical objects.

BRIEF DESCRIPTION OF THE DRAWINGS

FIG. 4 is a perspective view of a compoundly curved dome according to the first embodiment of the invention.

DETAILED DESCRIPTION OF THE INVENTION

Figure 1:
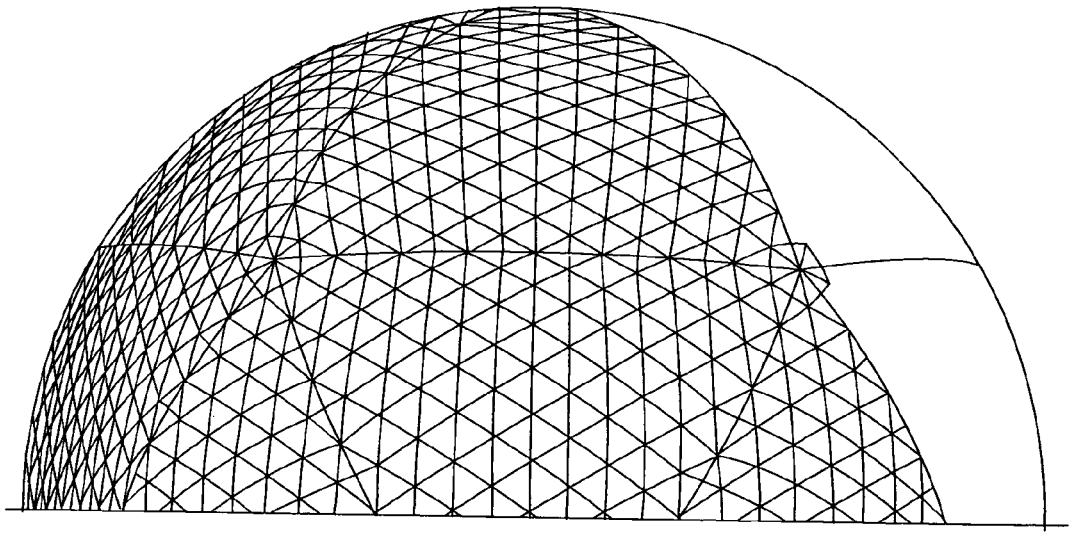
FIG. 1 (Prior Art)
FIG. 1 shows a geodesic dome based on a spherical icosahedron (prior art).
Figure 2:
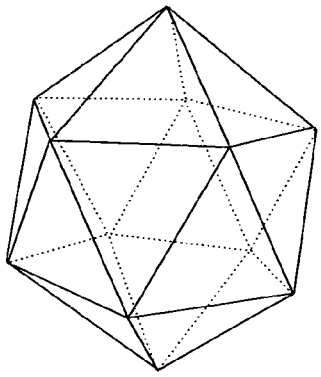
FIG. 2 (Prior Art)
FIG. 2 shows an icosahedron (prior art).
Figure 3:
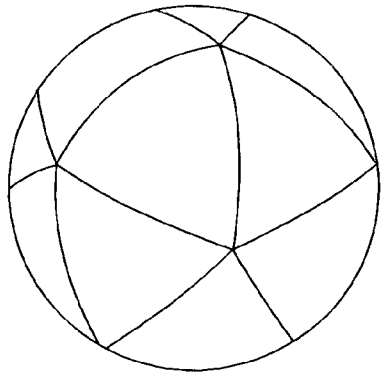
FIG. 3 shows a spherical icosahedron (prior art).

FIG. 1 shows a dome (prior art) based on the icosahedron, which is the basis for almost all geodesic structures or domes that are constructed. A polygonal single-frequency icosahedron and a corresponding spherical icosahedron are shown in FIGS. 2 and 3, respectively.

Figure 5:
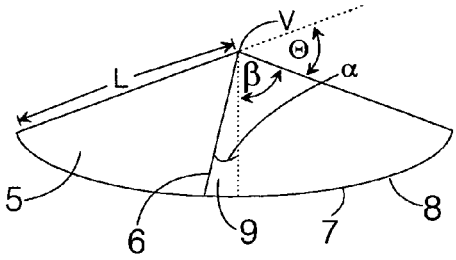
FIG. 5 shows a hub element of the Preferred Embodiment of the geodesic structure according to the present invention.

FIG. 4 shows a first embodiment of a dome 100 according to the present invention and FIG. 5 shows a hub element 5. The dome 100 comprises a plurality of the hub elements 5, arranged so that each individual hub element 5 overlaps with adjacent hub elements 5. As can be seen in FIG. 5, a section of material 9 is removed from a planar disc 8 between an imaginary vertical line 12 that extends from the center of the planar disc 8 to a hub base 7 and a deficit line 6 to create an angular deficit $\alpha$ in the hub element 5. The edges that form the angular deficit $\alpha$ are then brought together and fastened, so as to form the hub element 5. The center of the planar disc 8 now forms a vertex V. Referring to FIG. 4, virtual struts S are indicated by dotted lines that extend between the vertexes V. The hub elements 5 are arranged in an approximate fashion, that is, they are spaced for the most part approximately evenly apart, but deviations from this even spacing may occur in any direction, as illustrated in the varying amount of overlap of hub elements 5A, 5B, 5C, and 5D with their respective adjacent hub elements. The hub elements 5A and 5B, for example, are spaced quite evenly relative to one another with a maximum amount of overlap. The edge of the hub element 5A almost touches the vertexes of hub element 5B and other adjacent hub elements. The hub elements 5C and 5D, on the other hand, do not overlap to the same extent with some of their respective adjacent hub elements. For example, the overlap from the hub element 5C does not come as close to the vertex of the hub element 5B, Also evident from FIG. 4 is the fact that the hub elements 5 are not placed in defined rows. The variances in overlap are due to differences in placement, size, and/or conical taper, as is described in greater detail below. Despite these variances, the dome 100 will have approximately the desired shape. In this first embodiment, the hub element 5 is made from a plastic-coated disc of a paper-honeycomb-sandwich-construction. Many other stiffly flexible materials are suitable for the hub elements 5 such as, but not limited to, sheet metal, oriented-strand board, sheet plastic, paperboard, corrugated cardboard, wood, fiberglass, carbon fiber, leather, woven fiber, including plant fiber, etc., or suitable combinations of material.

Figure 14:
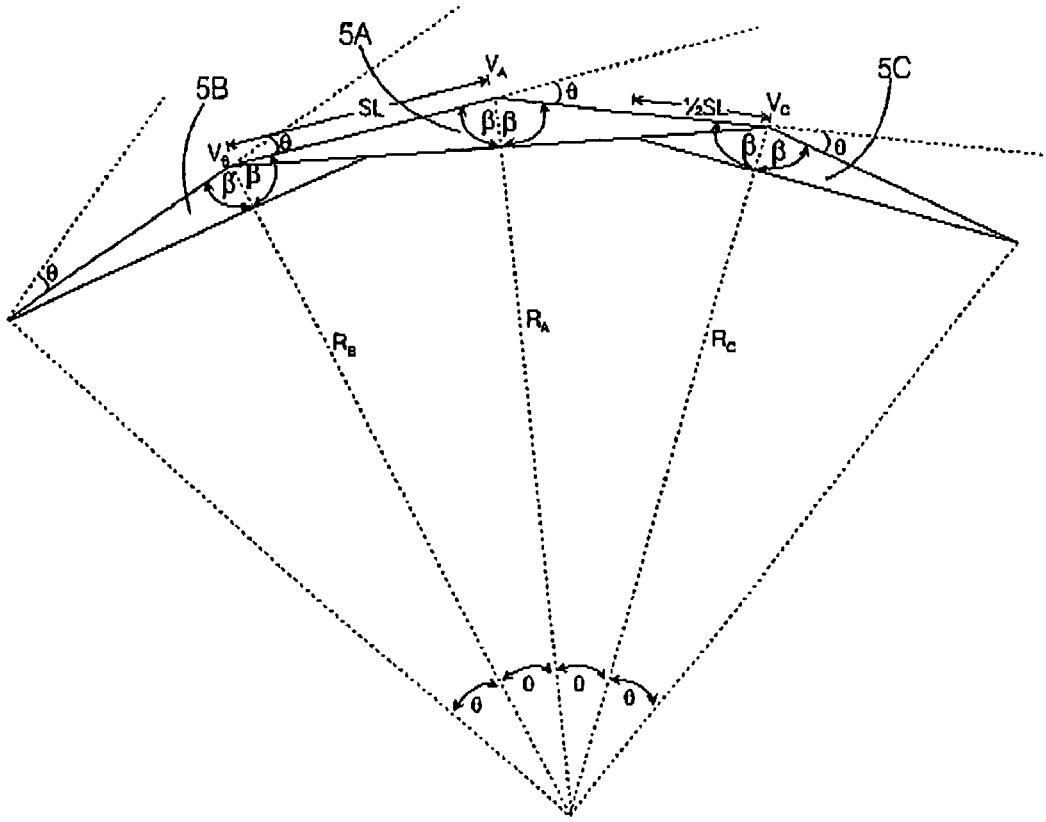
FIG. 14 is an orthogonal view of a paial cross-section of the dome 100 of FIG. 5

Also shown in FIGS. 5 and 14 is an angle of structure $\theta$, also referred to as an external angle $\theta$ and, when referring to this first embodiment, a dome angle $\theta$. As shown, the angle of structure $\theta$ is formed by an imaginary straight line $I_1$ that extends from the plane of a first side of the hub element 5 beyond the vertex V and the plane of a second side of the hub element 5. For purposes of illustration, the radius R of the dome 100 is 5 m, the dome angle $\theta$ is 10°, and the number of hub elements 5 and a strut length SL are to be calculated. FIG. 14 shows an orthogonal view of a partial cross-section of the geodesic dome 100 constructed according to the first embodiment of the invention. Several hub elements $\mathbf{5}_A$, $\mathbf{5}_B$, and $\mathbf{5}_C$, each with a vertex $V_A$, $V_B$, and $V_C$, respectively, and an internal angle $\beta$, are shown arranged around a diameter of the dome 100. The overlap between adjacent hub elements 5 is the maximal overlap, whereby the outer perimeter of hub element $\mathbf{5}_A$, for example, approaches the vertexes of adjacent hub elements $\mathbf{5}_B$, and $\mathbf{5}_C$.

To calculate the number of hub elements 5 needed for a semisphere, the solid angle of 360° is divided by the angular deficit $\alpha$. Knowing that the dome angle $\theta$ is 10°, the internal angle $\phi$ is then equal to $(180°-\theta)/2$, which is 85°. The angular deficit $\alpha$ is equal to 360° (1-sin $\beta$), which is 1.4°. The number of hub elements 5 required is then 360°/1.4°, that is, 257 hub elements 5. To calculate the hub length L, shown in FIG. 5, we first calculate the strut length SL, that is, the distance between vertexes V of the hub elements 5. As can be seen in FIG. 14, the strut length SL is equal to $\sin\theta \times R_A$, which, in this particular embodiment, is (0.174)(5 m)=0.87 m. The minimum hub length $L_{min}$ is SL/2 and the maximum hub length $L_{max}$ is slightly shorter than the strut length SL. With hub length $L_{min}$ and hub elements 5 that are arranged so as to just tangentially contact adjacent elements 5, the geodesic dome 100 comprising the 257 hub elements 5 described above will have a dome angle θ of 100, a radius R of 5 m, an angular deficit α of 1.4°, and strut length SL of 0.87 m. Any amount of overlap between adjacent hub elements 5 must be added to the minimum hub length to determine the actual hub length L.

In this first embodiment, the hub elements 5 are overlapped and, depending on the amount of overlap, the diameter of the resulting dome will be greater or smaller, but the dome angle θ will be 10°. The hub elements 5 can be overlapped maximally such that the outer edge of one element approaches the vertex V of each element that is immediately adjacent to it, or can be overlapped by any lesser amount that is still adequate to provide a completely enclosed space within the dome 100

In the example described above, the dome angle θ, which corresponds to the external angle θ, was known to be 10°. The external angle θ is the amount of deflection between one leg of the hub element 5 and an extended line from the other leg of the same hub element 5 at the vertex V. As can be seen in FIG. 14, $(2\times\sin\beta)+\theta$ is equal to 180°. If the angular deficit α of the hub element 5 is known, the external angle θ of the hub element 5 and the angle of structure θ of the structure can be calculated because, based on simple trigonometric equations, it is known that sin β equals $(1-\alpha/180°)$. So, for example, if the angular deficit α is approximately 1.4°, the dome angle θ of the dome 100 is approximately 10°.

Since θ is a function of the angular deficit α of the hub element 5, it is possible to first define the dimension of the angular deficit α and then derive the other variables. If the Preferred Embodiment of the geodesic dome 100 is to be constructed of hub elements 5 that are provided as flat, circular sheets, it is a relatively simple matter to calculate the amount of material that must be removed from the circular sheets to produce suitable hub elements 5. If the desired dome angle θ, the desired radius, and the number of available sheets are known, the angular deficit α to construct a dome with the desired dimensions can be calculated. So, for example, if the desired dome angle θ is 8.5°, the angular deficit $\alpha=360(1-\sin\beta)$. The internal angle $\beta=(180°-8.5)/2=85.75°$. Therefore, a=0.99°. The number of hub elements 5 and the strut length SL are calculated as in the previous example.

The number of hub elements 5 required to construct a particular dome depends on the strut length SL, the fraction of a sphere that the dome is to encompass, and the desired radius. It is, of course, possible to have a given number of hub elements 5 with a given angular deficit α and a given dimension for the overlap, and from these, determine the size of dome that can be constructed. The purpose of this illustration is not to limit the scope of the invention in any way, but rather, to show that a geodesic dome according to the present invention can be constructed to approximate dimensions, using only very basic mathematical skills and a basic calculator that has trigonometric functions. The construction according to the present invention is referred to as a "self-adjusting" structure, meaning that the individual hub elements 5 can be approximately arranged in an overlapping manner and can be adjusted with more or less overlap to compensate for partial elements that would be required mathematically to make a sphere. For example, if the angular deficit α is 7°, the number of hub elements 5 required to construct a dome according to the method of the present invention is 51.4. The dome can be constructed with 51 or with 52 hub elements 5, some of which are adjusted slightly to overlap more or less to accommodate for the missing or added partial element.

Figure 6:
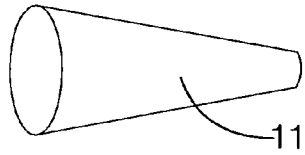
FIG. 6 shows a truncated cone hub element of a first alternative embodiment according to the present invention.
Figure 7:
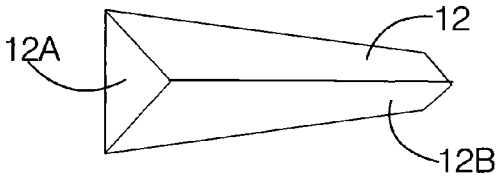
FIG. 7 shows a tapered triangular tapered tube hub element of a second alternative embodiment according to the present invention.
Figure 8:
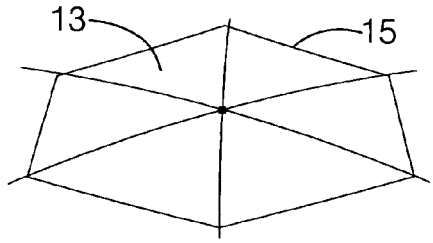
FIG. 8 shows a six-triangle strutted frame hub element of a third alternative embodiment according to the present invention.
Figure 9:
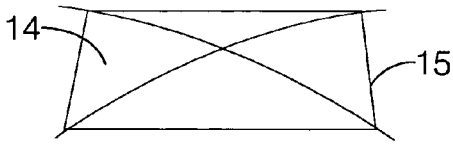
FIG. 9 shows a four-triangle strutted frame hub element of a fourth alternative embodiment according to the present invention.
Figure 10:
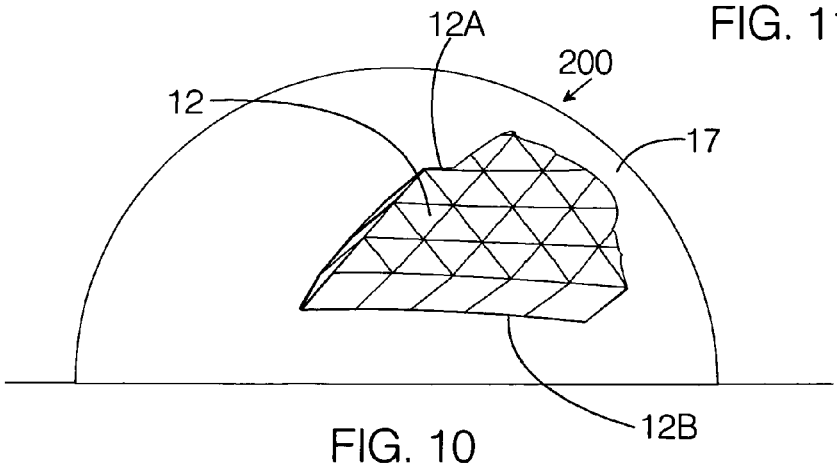
FIG. 10 shows a partial view of geodesic structure according to the present invention, constructed of tapered triangular tube hub elements and covered with a skin.
Figure 15:
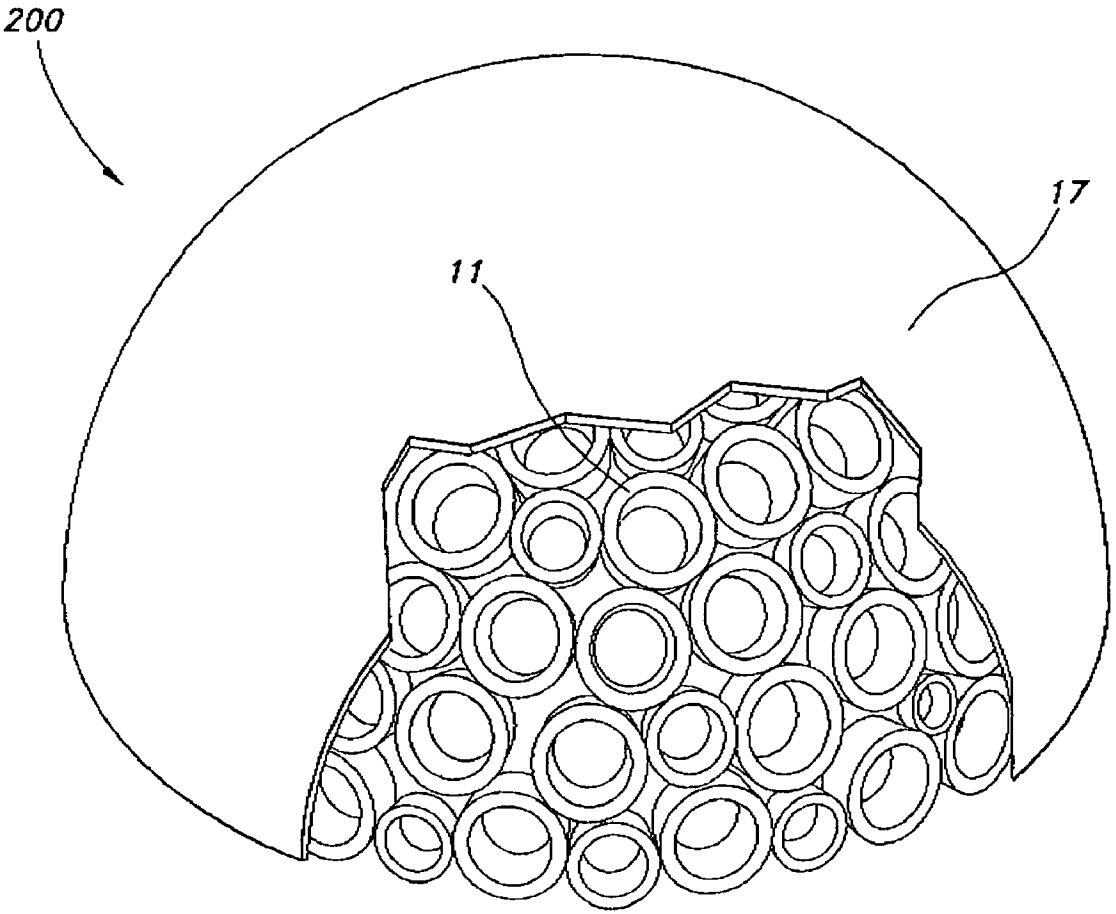
FIG. 15 shows a partial view of a geodesic structure according to the present invention, constructed of truncated conical hub elements.
Figure 16:
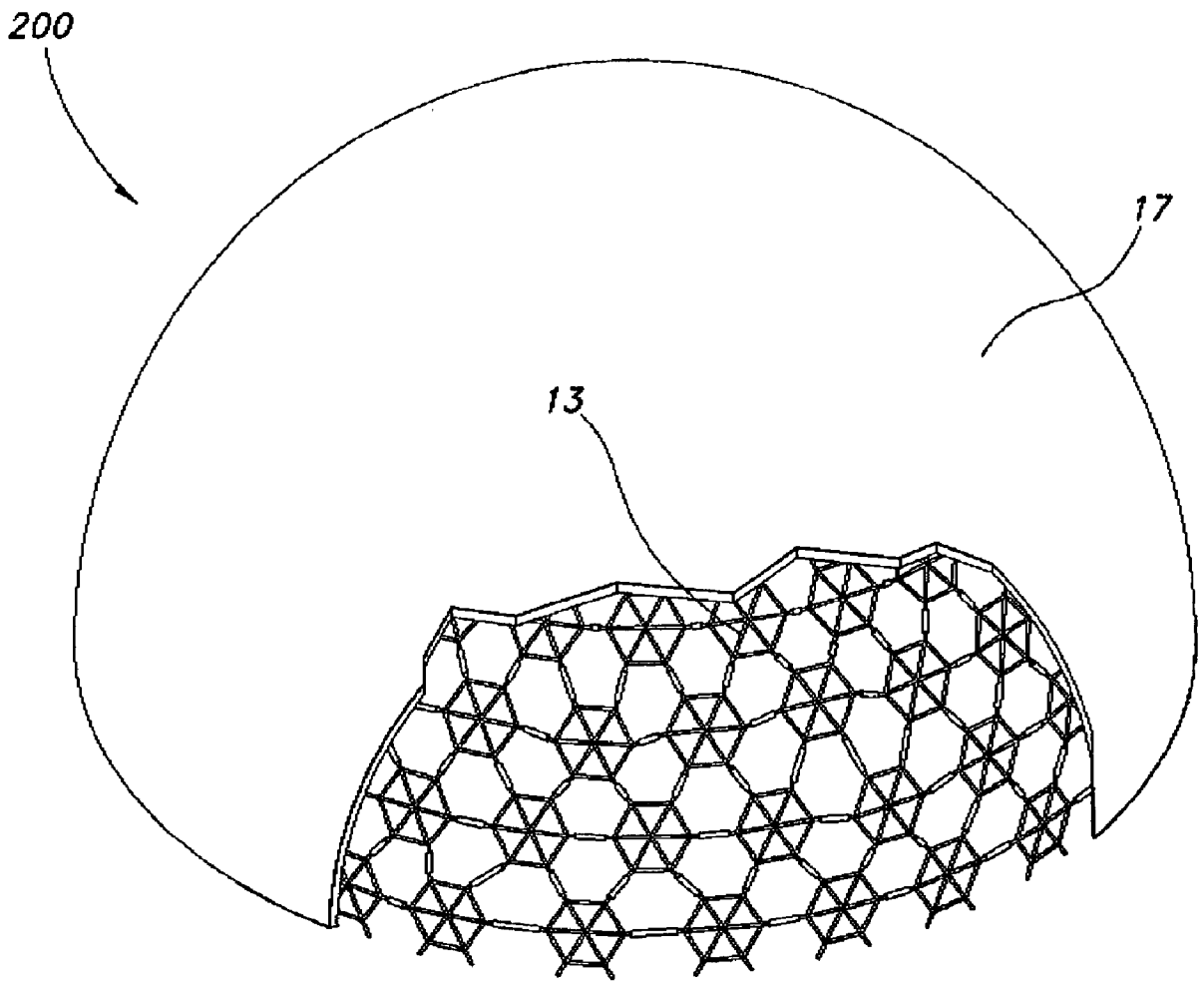
FIG. 16 shows a partial view of a geodesic structure according to the present invention, constructed of tensegrity elements.

FIGS. 6, 7, 8, and 9 illustrate other types of hub elements that can be used to construct further embodiments of a geodesic structure according to the present invention. FIG. 6 shows a truncated cone 11 for constructing a first alternative embodiment, FIG. 7 a tapered triangle 12 for constructing a second alternative embodiment, and FIGS. 8 and 9 show strutted frame elements 13 and 14, respectively, for constructing third and fourth alternative embodiments, respectively, of the geodesic structure according to the present invention. FIG. 10 shows a partial view of the second alternative embodiment of a dome 200 constructed of the tapered triangular elements 12 and a skin 17. Each triangular element 12 has a wide end 12A and a narrow end 12B. The elements 12 are arranged such that each element 12 is touching adjacent elements 12, with the narrow end 12B facing in toward the center of the dome 200 forming the concave inner surface and the wide end 12A forming the outer convex surface. The first alternative embodiment according to the present invention uses the tapered truncated cones 11, is constructed similarly to the dome 200, and is also covered with a skin, as shown in FIG. 15.

Figure 11:
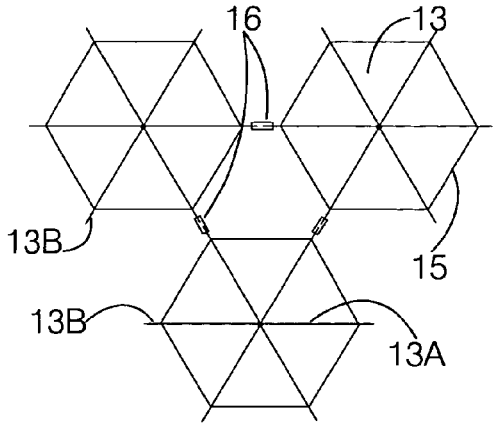
FIG. 11 shows a plurality of strutted frame elements according to the present invention, connected to each other with an adjustable coupler.

FIG. 11 shows a partial surface of the third alternative embodiment according to the present invention of a dome being constructed with the strutted frame elements 13. The elements 13 are hexagonal in shape and comprise three struts 13A that are crossed in the center so as to form the hexagonal shape. A tension element 15 forms the perimeter of the strutted frame element 13 and is fastened with sufficient tension to force the struts 13A into a slightly bowed or convex-concave configuration. In this third alternative embodiment, strut ends 13B protrude beyond the perimeter of the strutted frame element 13. Adaptable couplers 16 are used to couple two strut ends 13B of two adjacent strutted frame elements 13. A plurality of frame elements 13 can be connected to form a sphere having the dome angle θ corresponding to the dome angle α of the strutted frames 13. The dome constructed of such elements is then covered with a skin, similar to the dome 200 described above, as shown in FIG.

Figure 12:
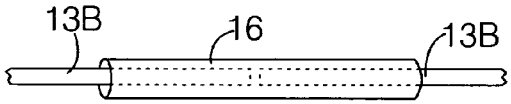
FIG. 12 shows an adjustable coupler to adjustably hold the strut ends of strutted frames in position within a structure constructed according to the present invention.

FIG. 12 illustrates a very simple type of adaptable coupler 16, which is a tube, open at both ends. The strut ends 13B of two different strutted frame elements 13 can be inserted into the coupler 16. The coupler 16 is long enough to slidably hold the strut ends 13B within the coupler 16, yet allow the strut ends 13B to slidably adjust the position of the strutted frame elements 13 in place within the structure under construction. Many types of adaptable couplers 16 are available and suitable for holding the strutted frame elements 13 in a proper relationship to the other strutted frame elements 13 in the structure. Suitable couplers include clamps or tubes with holes or slots through which set screws or locking pins are insertable to hold the strut ends 13 in position.

Figure 13:
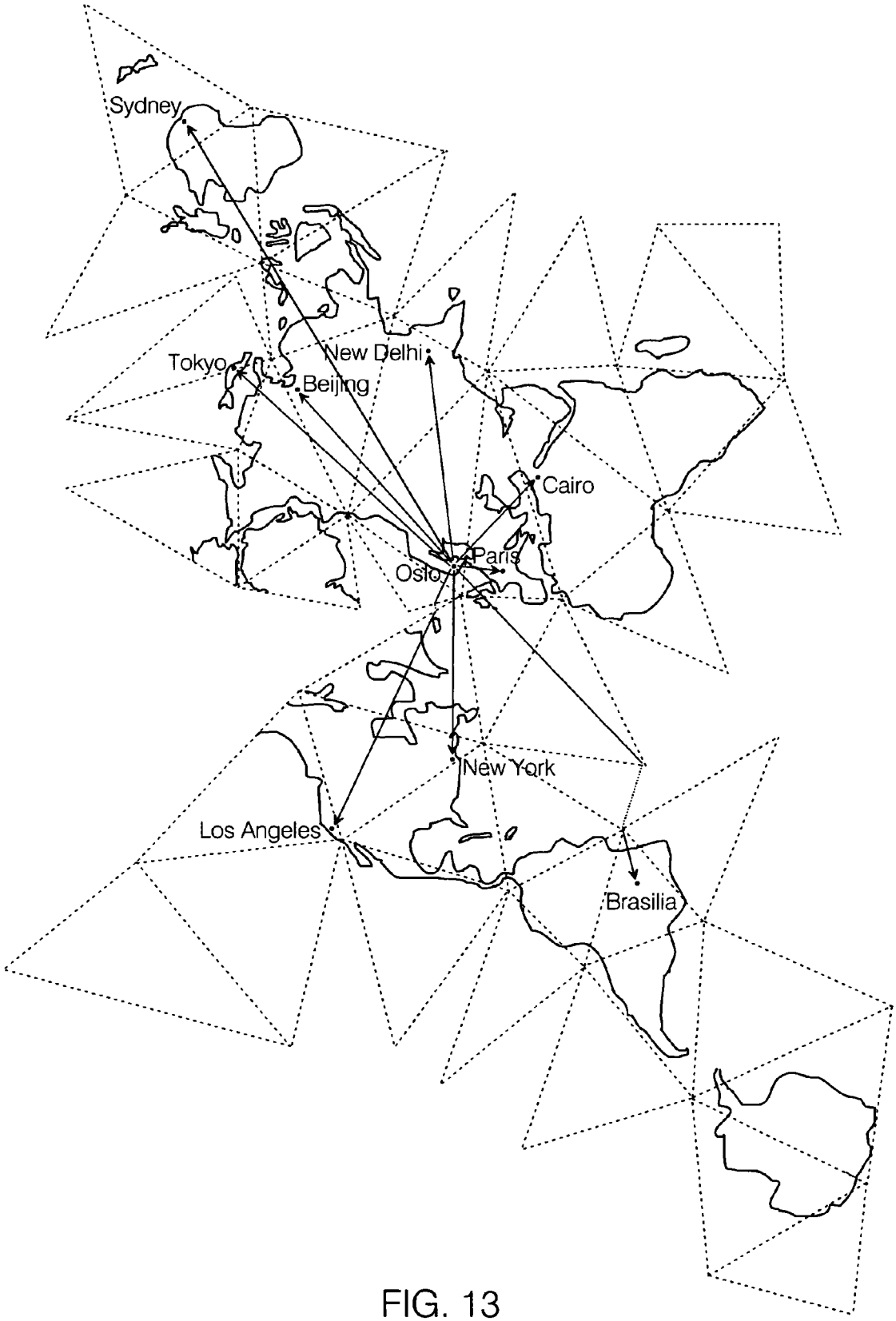
FIG. 13 is an illustration of a map of the earth that was projected onto a sphere, with vertexes and triangles arranged according to the present invention and cut along edges of several triangles to create a flat map.

FIG. 13 illustrates a fifth embodiment of the invention, a map 500 of the earth. For purposes of illustration only, Oslo, Norway is the major point of interest on the map 500 and is located somewhat near the center of the map 500. The intended application of the map is to illustrate travel routes from Oslo to other points in the world. Initially, orthogonal projections of places of major interest are projected onto a sphere, each place of major interest surrounded by vertexes 18. Attention is given not to place the vertexes 18 on areas of particular interest, but instead, to place them in areas of lesser interest, with respect to the particular focus of the map 500. Connecting lines 19 are drawn on the sphere to connect the adjacent vertexes 18. The resulting pattern made by the connecting lines 19 shows that the map 500 is omni-triangulated and that the triangles vary in size and are in some instances scalene triangles. The map 500 is then cut along some of the connecting lines 19 to allow the map 500 to lie flat. The map 500 has very little distortion, as the entire map is constructed of cartographic images of limited sections of the earth taken as orthogonal views.

The embodiments mentioned herein are merely illustrative of the present invention. It should be understood that variations in construction and assembly of the present invention may be contemplated in view of the following claims without straying from the intended scope and field of the invention herein disclosed.

What is claimed is:

1. A geodesic structure comprising a plurality of conical elements, each conical element of said plurality of conical elements being a structurally single component having a cone base, a cone wall and a vertex, said cone wall defined by straight lines that extend from said base and intersect each other at said vertex, the length of a straight line from said vertex to said cone base defining a cone-wall length, wherein said plurality of conical elements are arranged in an overlapping arrangement, so as to form a shell that surrounds an inner volume, wherein a portion of said base of a first conical element overlaps with a portion of said cone wall of an adjacent conical element, such that at least one straight line of said cone wall of said first conical element extends substantially parallel to at least one straight line in said cone wall of said adjacent conical element so as to form together a straight strut between said vertex of said first conical element and said vertex of said adjacent conical element, and wherein said plurality of conical elements are arranged such that a distance and a direction of displacement between any two vertexes of adjacently placed conical elements provides an adjustability of said straight strut that is a strut distance that is infinitely variable between a minimum limit and a maximum limit by adjusting an amount of overlap, said maximum limit of said straight strut being slightly less than a sum of cone-wall lengths of any two adjacent conical elements and said minimum limit of said straight strut is being slightly greater than said cone wall length of one of said two adjacent conical elements.

2. The geodesic structure of claim 1, wherein said portion of said conical element base of said first cone overlaps a portion of said cone wall of at least three adjacent conical elements, so as to form said shell having a closed surface, and wherein said strut distance includes a first strut distance, a second strut distance, and a third strut distance;

wherein said overlapping arrangement further includes an overlap of a portion of said cone base of said first conical element with a portion of said cone wall of at least a second conical element, a third conical element, and a fourth conical element;

wherein a first amount of overlap between said first conical element and said second conical element forms said first strut distance and direction between said vertexes of said first conical element and said second conical element, a second amount of overlap between said first conical element and said third conical element forms said second strut distance and direction between said vertexes of said first conical element and said third conical element, and a third amount of overlap between said first conical element and said fourth conical element forms said third strut distance and direction between said vertexes of said first conical element and said fourth conical element; and wherein said first strut distance and direction is any distance and direction between said minimum and said maximum limits, said second strut distance and direction is any distance and direction between said minimum and said maximum limits, and said third strut distance is any distance and direction between said minimum and said maximum limits.

3. The geodesic structure of claim 2, wherein an opening is formed in said shell to provide access to an inner space of said shell.

4. The geodesic structure of claim 1, wherein said conical element has an angular deficit $\alpha$ that defines an amount of taper of said cone wall between said cone base and said vertex, and wherein said angular deficit $\alpha$ of said conical element varies in magnitude from said angular deficit $\alpha$ of an adjacent conical element.

5. The geodesic structure of claim 4, wherein said plurality of conical elements includes two groups of conical elements, each group having a different magnitude of said angular deficit $\alpha$, and wherein said conical elements of said two groups are arranged in an alternating pattern.

6. The geodesic structure of claim 1, further comprising a skin that is placed over said shell.

7. The geodesic structure of claim 1, wherein said conical elements are arranged with said vertex of some of said conical elements facing inward and with said vertex of other ones of said conical elements facing outward, so as to form said shell having an irregular shape.

8. The geodesic structure of claim 1, wherein said conical element is constructed of sheet material from a group of material consisting of paper fiber products, wood fiber products, composite material, sheet metal, corrugated metal, polymeric material, rubber, woven materials, pressed materials, coated materials, and combinations thereof.

9. The geodesic structure of claim 1 further comprising a fastening means for attaching said plurality of conical elements to one another, wherein said fastening means includes means from the group consisting of adhesive means, threaded fasteners, staples, crimped edges, folded edges, rivets, hook-and-loop fasteners, nails, and combinations thereof.

* * * * *